US007496320B2

(12) United States Patent
Kimura et al.

(10) Patent No.: US 7,496,320 B2
(45) Date of Patent: Feb. 24, 2009

(54) TONER SUPPLY DEVICE PROVIDING TONER AGITATION AND DEVELOPING UNIT USING THE SAME

(75) Inventors: Takahiko Kimura, Ikoma (JP); Ryosuke Mano, Kashiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 65 days.

(21) Appl. No.: 11/600,841

(22) Filed: Nov. 17, 2006

(65) Prior Publication Data

US 2007/0116495 A1 May 24, 2007

(30) Foreign Application Priority Data

Nov. 21, 2005 (JP) ..... 2005-335340

(51) Int. Cl.
*G03G 15/08* (2006.01)

(52) U.S. Cl. ..... 399/258

(58) Field of Classification Search ..... 399/252, 399/254–256, 258
See application file for complete search history.

(56) References Cited

U.S. PATENT DOCUMENTS 5,943,538 A * 8/1999 Choi ..... 399/258
6,597,882 B1 * 7/2003 Tanaka ..... 399/258
6,978,108 B2 * 12/2005 Sakamaki ..... 399/258
7,110,707 B2 * 9/2006 Nishitani ..... 399/258
7,139,516 B2 * 11/2006 Makino ..... 399/258
7,257,353 B2 * 8/2007 Kawai et al. ..... 399/254
2006/0182470 A1 * 8/2006 Tamura et al. ..... 399/258
2006/0216067 A1 * 9/2006 Okoshi ..... 399/258
2006/0222412 A1 * 10/2006 Ito et al. ..... 399/258
2007/0122206 A1 5/2007 Mano et al.

FOREIGN PATENT DOCUMENTS

JP 2002-278236 A 9/2002
JP 2003-162143 A 6/2003

OTHER PUBLICATIONS

U.S. Office Action mailed Feb. 4, 2008 in corresponding U.S. Appl. No. 11/603,092.

* cited by examiner

*Primary Examiner*—David M Gray
*Assistant Examiner*—Ruth N Labombard
(74) *Attorney, Agent, or Firm*—Nixon & Vanderhye, P.C.

(57) ABSTRACT

A toner supply device for supplying toner to a developing unit, includes: a toner cartridge for storing toner; and a toner feed device disposed adjacent to the toner cartridge and composed of a casing for reserving the toner supplied from the toner cartridge and first and second toner agitator shafts for agitating and conveying the toner inside the casing, and is constructed such that the toner feed device agitates the toner supplied from the toner cartridge first, then feeds the agitated toner to the developing unit.

9 Claims, 6 Drawing Sheets

TONER SUPPLY DEVICE PROVIDING TONER AGITATION AND DEVELOPING UNIT USING THE SAME

This Nonprovisional application claims priority under 35 U.S.C. § 119(a) of Patent Application No. 2004-326609 filed in Japan on 21 Nov. 2005, the entire contents of which are hereby incorporated by reference.

BACKGROUND (1) Field of the Invention

The present technology relates to a toner supply device and a developing unit using this, in particular relating to a toner supply device and a developing unit for use in an image forming apparatus for performing image formation with toner.

(2) Related Art and Other Considerations

Conventionally, in image forming apparatuses using toner, such as copiers, facsimile machines, etc., a toner supply device such as a toner cartridge etc., is used to supply toner to the developing unit to thereby achieve continuous operation of image output.

There is a generally known method for supplying toner to the developing unit, in which toner stored in a toner cartridge is directly supplied to the developing unit (see Japanese Patent Application Laid-open 2003-162143).

However, the conventional method of directly supplying toner from the toner cartridge to the developing unit suffers the problem that the fluidity of the supplied toner is prone to vary, resulting in variations in image quality. Moveover, in a configuration where toner which has been degraded in fluidity (due to long-term inactivity or the like) is processed into high-fluidity toner so as to be supplied without hindrance, toner beyond a controlled amount may be supplied to the developer, causing the problem that the toner concentration in the developer rises, exerting influence on image quality and color tones.

In particular, in a tandem-type color image forming apparatus that requires high image quality, four image forming process units corresponding to four colors, i.e., YMCK, need to be arranged. And yet the developing units are required to be miniaturized so as to meet the demand for a compact equipment configuration. As a result, problems occur with the miniaturization of the developing units. That is, it becomes difficult to ensure uniform toner properties attributed to fluidity, such as charge quantity, toner concentration and the like, by agitation, and it also becomes difficult to secure the capability of absorbing the variations in supply quantity.

BRIEF SUMMARY

The present technology has been devised in view of the above conventional problems. It is therefore an object of the present technology to provide a toner supply device and a developing unit using the device, which uniformly supplies the toner to the developing unit and which achieves stable toner supply based on toner supply control, even when toner of a high fluidity is supplied.

The toner supply device and developing unit according to the present Technology for solving the above problem are configured as follows.

The first aspect of the present technology provides a toner supply device for supplying toner to a developing unit, comprising: a toner container for storing toner; and a toner feed device disposed adjacent to the toner container and including a toner reservoir for reserving the toner supplied from the toner container, and a toner conveyor for conveying the toner in the toner reservoir while agitating the toner. The toner feed device agitates the toner supplied from the toner container first, then feeds the agitated toner to the developing unit.

A toner supply device according to a second aspect of the present technology, in addition to the configuration described in the first aspect, comprises a toner input portion for allowing entrance of toner from the toner container to the toner reservoir, and a toner feed portion for feeding toner from the toner reservoir to the developing unit. The developing unit includes a developing roller for conveying the fed toner to the exterior of the developing unit. The toner input portion and the toner feed portion are arranged outside the location of the developing roller with respect to the direction along the developing roller's axis. The toner conveyor conveys and circulates the toner that has been input from the toner input portion through the ways along the direction of the developing roller's axis, by the length that is equal to or longer than the length in the direction along the developing roller's axis first, then delivers the toner to the toner feed portion.

In a toner supply device according to a third aspect of the present technology, in addition to the configuration described in the first or second aspect, the toner conveyor comprises a screw element or a plurality of agitating plates tilted with the toner conveying direction.

In a toner supply device according to a fourth aspect of the present technology, part of the toner supplied from the toner container is conveyed to the toner feed portion by way of a first toner path that is created outside the location of the developing roller with respect to the direction of the developing roller's axis, while the remaining toner is conveyed to the toner feed portion by way of a second toner path that is extended along the direction of the developing roller's axis.

A developing unit according to a fifth aspect of the present technology is equipped with a toner supply device which includes: a toner container for storing toner to supply toner to the developing unit with a toner supply device defined in any one of the above first to fourth aspects being included as the toner supply device.

According to the first aspect of the present technology, since the toner in the toner reservoir is agitated by the toner conveying means, it is possible to constantly supply the toner in a uniform condition to the developing unit. Hence it is possible to realize stable toner supply based on toner supply control even with the toner having a high enough fluidity.

Further, in addition to the above common effect that is obtained from the first to third aspects of the technology, each aspect of the technology has the following effect.

According to the second aspect of the technology, the toner input portion and the toner feed portion are arranged outside the location of the developing roller with respect to the direction of the developing roller's axis. Therefore, for example, it is possible to prevent the transfer belt, paper feeder and paper feed path from being dirtied by the developing unit, specifically, with the toner dropping to the toner input portion and therearound when the toner container is attached to or detached from the toner feed device, and with the toner dropping to the toner feed portion and therearound when the toner feed device is attached to or detached from the developing unit.

Further, since the toner conveyor is adapted to convey and circulate the toner that has been input from the toner input portion, through the ways along the direction of the developing roller's axis, by the length that is equal to or longer than the length in the direction along the developing roller's axis, then deliver the toner to the toner feed portion, it is possible to realize efficient toner agitation effect within the limited toner storage space inside the toner reservoir. With this configuration, since the path (circulating path) for conveying toner while agitating is rather long, it is possible to supply the toner according to the intended control while suppressing direct toner inflow into the developing unit.

According to the third aspect of the present technology, since the toner conveyor is formed of a screw element or a plurality of agitating plates tilted with the toner conveying direction, it is possible to agitate and convey toner with a simple structure.

According to the fourth aspect of the present technology, supplying toner by way of the first toner path enables quick and responsive toner supply while supplying toner by way of the second toner path makes it possible to supply uniformed toner with improved fluidity.

Further, according to the fifth aspect of the present technology, since the toner in the toner reservoir is agitated by the toner conveyor, it is possible to constantly supply the toner in a uniform condition to the developing unit, and it is also possible to realize stable toner supply based on toner supply control even with the toner having a high enough fluidity. As a result it is possible to provide stable and high quality images.

DETAILED DESCRIPTION

Figure 1:
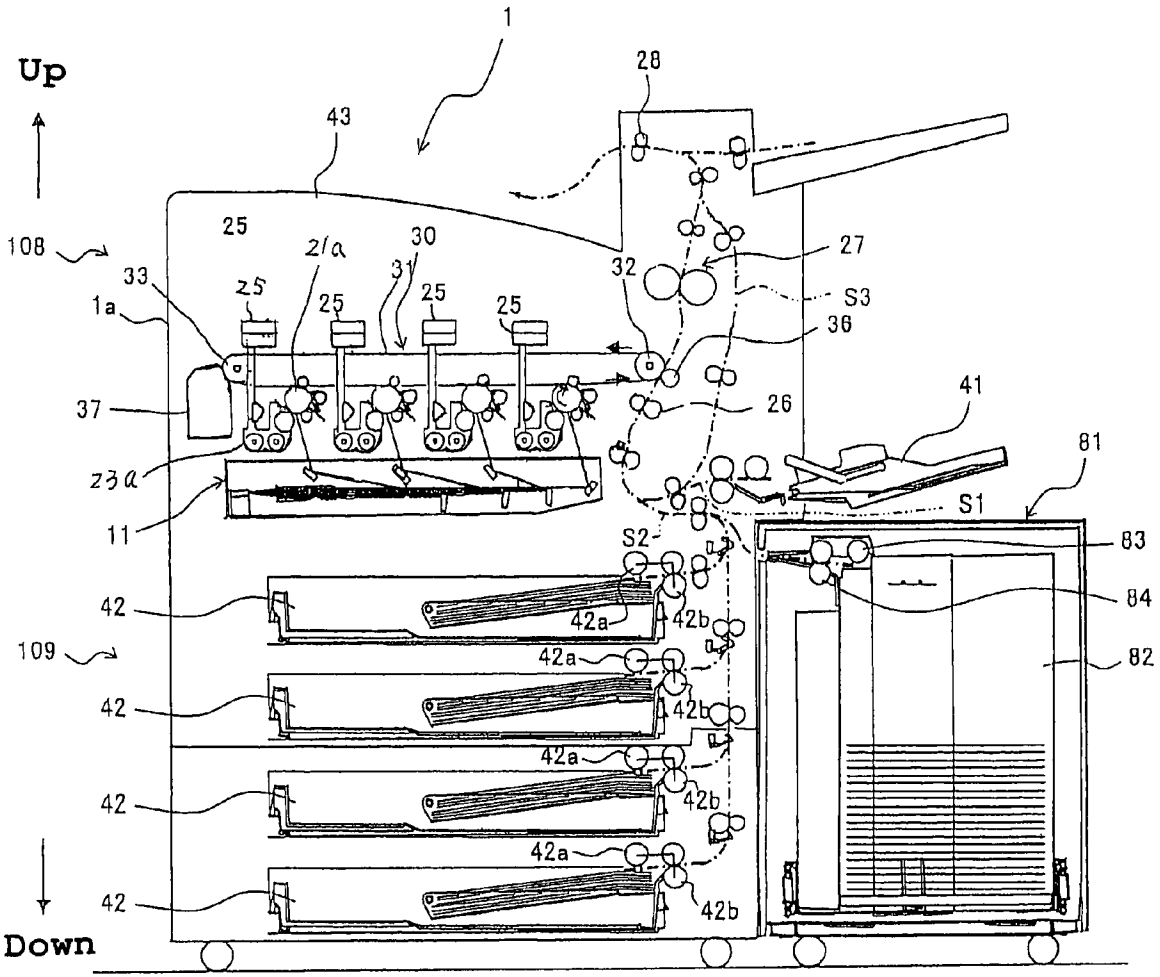
FIG. 1 is an illustrative view showing an overall configuration of an image forming apparatus adopting a developing unit according to an example embodiment.
Figure 2:
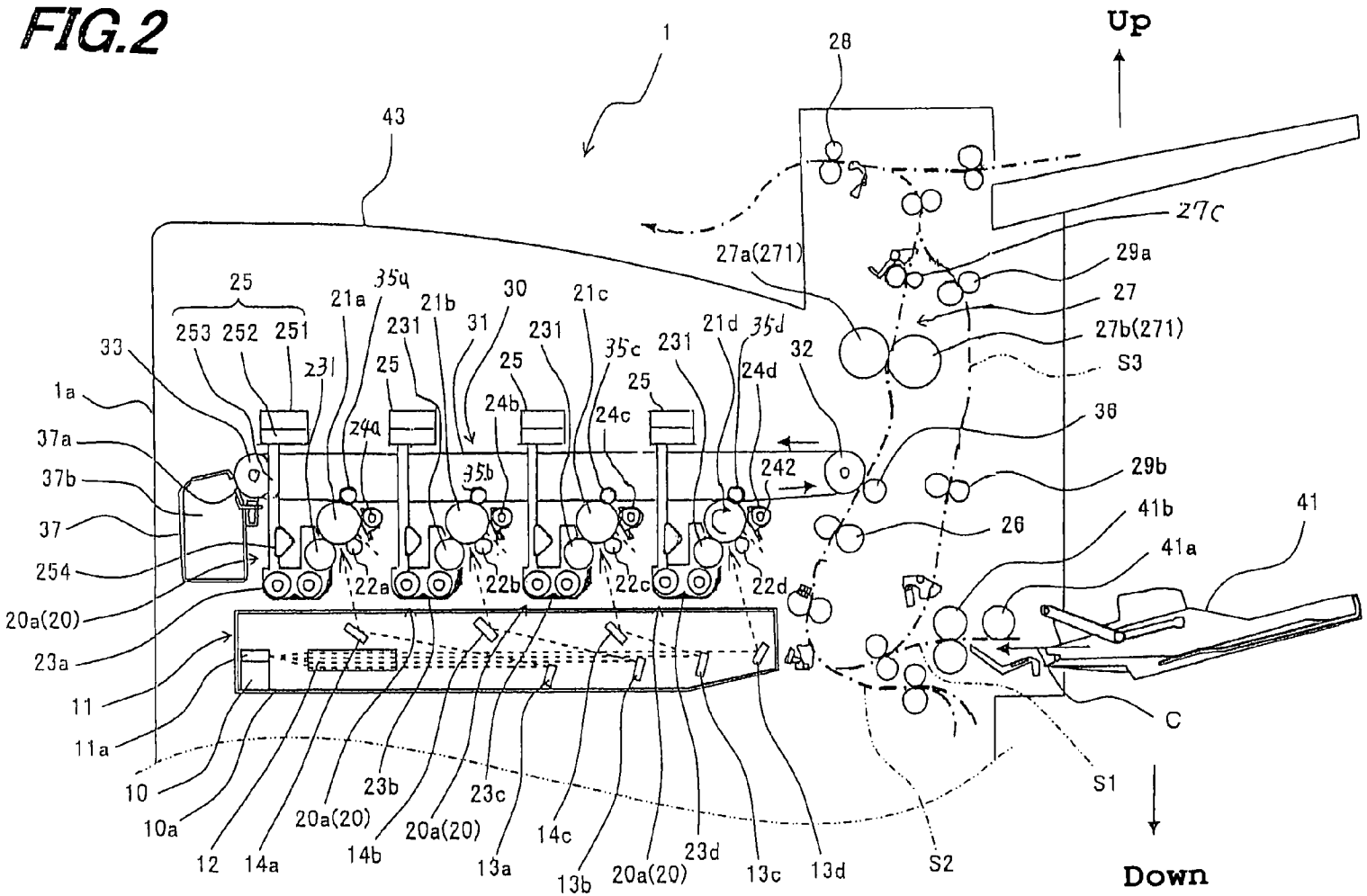
FIG. 2 is a partial detailed view showing a configuration of image forming units for constituting the image forming apparatus.
Figure 3:
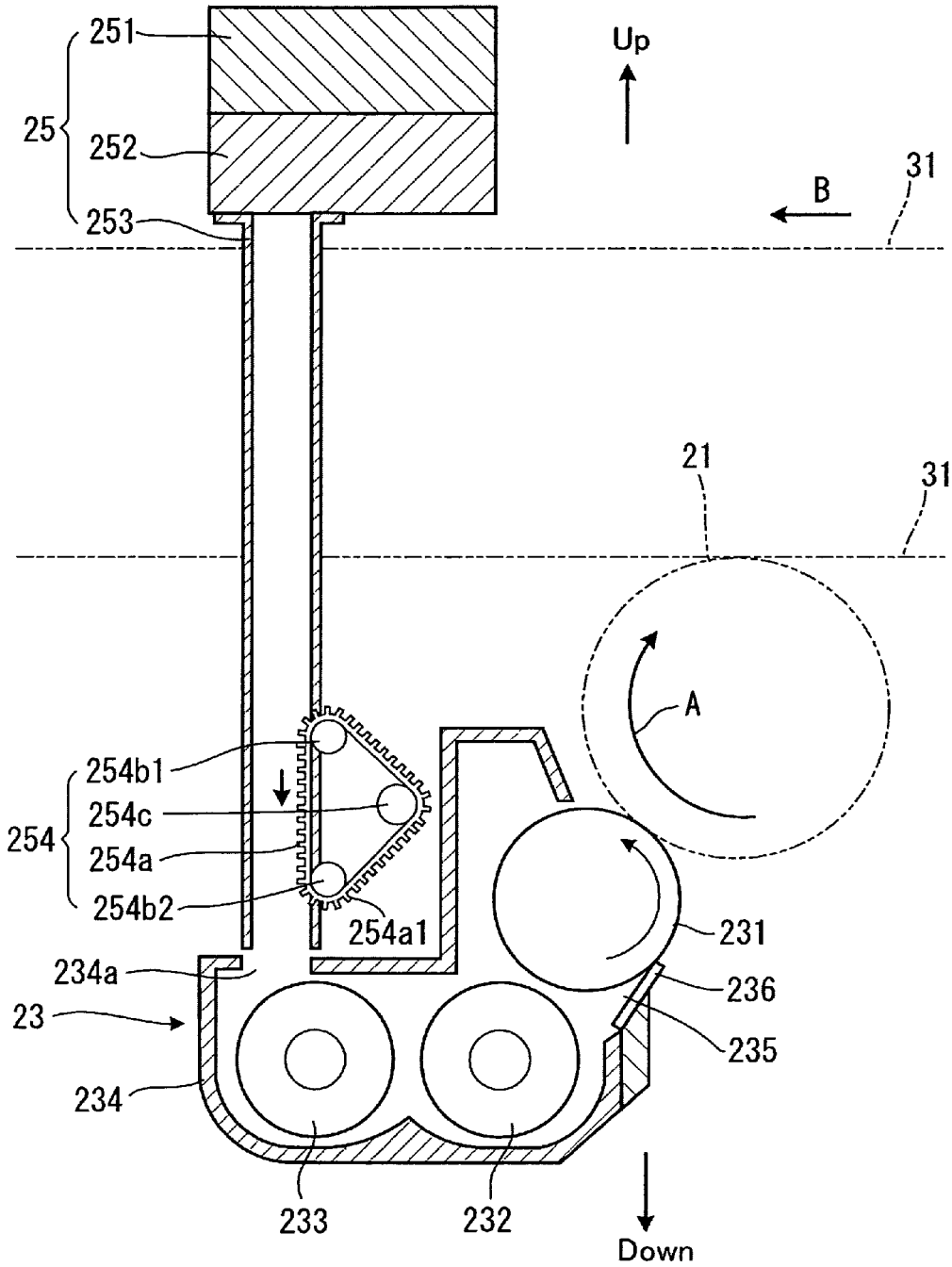
FIG. 3 is a side sectional view showing a configuration of a developing unit and a toner supply device for constituting the image forming apparatus.

FIG. 1 is an illustrative view showing an overall configuration of an image forming apparatus adopting a developing unit according to example embodiment. FIG. 2 is a partial detailed view showing a configuration of image forming units for constituting the image forming apparatus. FIG. 3 is a side sectional view showing a configuration of a developing unit and a toner supply device for constituting the image forming apparatus.

As shown in FIG. 3, the present embodiment is a developing unit 23 (FIG. 3) for use in an image forming apparatus 1 (FIGS. 1 and 2) in which the developer supplied from a developing roller 231 to a photoreceptor drum 21 in accordance with image data is transferred to a recording sheet by way of a transfer process. The developing unit 23 has a toner cartridge (toner container) 251 for storing toner and a toner supply device 25 for supplying toner to developing unit 23 so as to enable continuous image output operation by automatic toner supply to the developing unit 23.

As shown in FIGS. 1 and 2, image forming apparatus 1 to which developing unit 23 according to the present embodiment is mounted includes a plurality of process printing units (image forming means) 20 (20*a*, 20*b*, 20*c* and 20*d*). Each process printing unit 20 has a photoreceptor drum 21 (21*a*, 21*b*, 21*c* or 21*d*) and a developing unit 23 for supplying the developer to the photoreceptor drum 21 surface. The image forming apparatus 1 further comprises an exposure unit (light scanning device) 10 for creating electrostatic latent images on photoreceptor drums 21 of individual colors by illumination of laser beams in accordance with image information; a transfer belt unit 30 having an endless transfer belt 31 for conveying the fed recording paper; and a fixing unit 27 for thermally fixing the toner image that has been transferred to the recording paper, by means of a heat roller 27*a* and a pressing roller 27*b*.

To begin with, the overall configuration of image forming apparatus 1 will be described.

As shown in FIGS. 1 and 2, image forming apparatus 1 according to the present embodiment is a so-called digital colors printer which is adapted to output a color image by separating image information into colors and forming images of individual colors. The image forming apparatus 1 mainly comprises of an image forming portion 108 and a paper feedportion 109, and forms multi-color images or monochrome images on recording paper in accordance with a print job sent from an information processor (not illustrated) such as a personal computer etc., externally connected.

Image forming portion 108 forms multi-color images based on electrophotography with yellow (Y), magenta (M), cyan (C) and black (BK) colors. This image forming portion mainly comprises exposure unit 10, process printing units 20, fixing unit 27, a transfer belt unit 30 having transfer belt 31 as a transfer means, transfer roller 36 and a transfer belt cleaning unit 37.

In the overall arrangement of image forming portion 108, fixing unit 27 is disposed on the top at one end side of a housing 1*a* of image forming apparatus 1. Transfer belt unit 30 is extended under the fixing unit 27 from one end side to the other end side of housing 1*a*. Process printing units 20 are disposed under the transfer belt unit 30. Exposure unit 10 is disposed under the process printing units 20.

Further, transfer belt cleaning unit 37 is arranged on the other end side of transfer belt unit 30. Also, a paper output tray 43 is arranged contiguous to fixing unit 27, over image forming portion 108. Paper feed portion 109 is arranged under the image forming portion 108.

In the present embodiment, four process printing units 20*a*, 20*b*, 20*c* and 20*d*, corresponding to individual colors, i.e., black (BK), yellow (Y), magenta (M) and cyan (C), are arranged as process printing units 20 sequentially in the direction of movement of transfer belt 31.

The process printing unit 20*a* for the color whose toner image (among all the toner images) is first transferred to transfer belt 31 is located at a position most distant from transfer roller 36 and holds a toner of black color so as to form a black toner image first on transfer belt 31.

These process printing units 20*a*, 20*b*, 20*c* and 20*d* are arranged sequentially in the approximately horizontal direction (in the left-to-right direction in the drawing) in housing 1*a*, and include respective photoreceptor drums 21*a*, 21*b*, 21*c* and 21*d*, respective chargers (charging means) 22*a*, 22*b*, 22*c* and 22*d*, respective developing units (developing means) 23*a*, 23*b*, 23*c* and 23*d*,and respective cleaner units 24*a*, 24*b*, 24*c* and 24*d*, as well as other components.

The symbols a, b, c, and d are added to the constituents for individual colors to show correspondence to black (BK), yellow (Y), magenta (M) and cyan (C), respectively. In the description hereinbelow, however, the constituents provided for each color are generally referred to as photoreceptor drum 21, charger 22, developing unit 23, and cleaner unit 24, except in the case where the constituents corresponding to a specific color need to be specified.

Photoreceptor drum 21 is arranged so that part of its outer peripheral surface comes into contact with the surface of transfer belt 31. A charger 22 (which serves as an electric field generator), developing unit 23 and cleaner unit 24 are arranged along, and close to, the outer peripheral surface of the drum 21.

A corona-wire charger is used as charger 22 and is arranged, at a position on the approximately opposite side across photoreceptor drum 21, from transfer belt unit 30 and close to the outer peripheral surface of photoreceptor drum 21. Though in the present embodiment a corona-wire charger is used as charger 22, any type of charger can be used without limitation, in place of the corona-wire charger, such as a fur brush type charger, magnetic brush type charger, roller-type charger, saw-toothed type charger, ion-generation charging device etc., as long as it can provide the desired charge performance to the photoreceptor drum.

Each developing unit 23 (23*a* to 23*d*) holds an associated toner of black (BK), yellow (Y), magenta (M) or cyan (C) color and is arranged on the downstream side of charger 22 with respect to the rotational direction of the photoreceptor drum (in the direction of arrow A in the drawing).

In developing units 23*a* to 23*d*, developing rollers 231*a* to 231*d* are arranged opposing respective photoreceptor drums 21*a* to 21*d*, respectively so as to visualize the electrostatic latent images formed on the outer peripheral surfaces of photoreceptor drums 21*a* to 21*d*, respectively, by supplying the associated colors of toners thereto.

Cleaner unit 24 is arranged on the upstream side of charger 22 with respect to the rotational direction of the photoreceptor drum. Cleaner unit 24 has a cleaning blade and is configured so that the front end of the cleaning blade is positioned in abutment with the outer peripheral surface of photoreceptor 21 so as to scrape and collect the leftover toner off the photoreceptor drum 21. A reference numeral 242 in the drawing designates a conveying screw for conveying the collected toner.

In the present embodiment, a cleaning blade is used but the cleaning unit is not limited to this configuration. One or more cleaning blades may be used or a fur-brush or magnetic brush may be used alone. Alternatively, a fur-brush or magnetic brush may be used in combination with a cleaning blade. That is, any configuration may be used as long as it can scrape and collect the leftover toner off the photoreceptor drum 21.

Exposure unit 10 (FIG. 2) mainly comprises a box-shaped housing 10*a*, a laser scanning unit (LSU) 11 (having a laser illuminator 11*a* incorporated in the housing 10*a*), a f-θ lens 12, and reflection mirrors 13*a*, 13*b*, 13*c*, 13*d*, 14*a*, 14*b* and 14*c* (for reflecting the laser beams for associated colors).

The laser beam emitted from the laser illuminator of laser scanning unit 11 is separated into components of different colors, by an unillustrated polygon mirror and f-θ lens 12, then the separated components of light are reflected by respective reflection mirrors 13*a* to 13*d* and 14*a* to 14*c* to illuminate the respective photoreceptor drums 21*a*, 21*b*, 21*c* and 21*d* of individual colors.

Concerning laser scanning unit 11, a writing head comprising an array of light emitting devices such as EL (electro luminescence), LED (light emitting diode) and others, may be used instead of the laser illuminator. Also, a light source in combination with a liquid crystal shutter may be used. That is, any configuration can be used as long as it can create an electrostatic latent image on the photoreceptor drum 21 surface.

As shown in FIG. 1, transfer belt unit 30 essentially comprises transfer belt 31, a transfer belt drive roller 32, a transfer belt driven roller 33, and intermediate transfer rollers 35*a*, 35*b*, 35*c* and 35*d*.

In the following description, any of the intermediate transfer rollers 35*a*, 35*b*, 35*c* and 35*d* will be referred to as intermediate transfer roller 35 when general mention is made.

Transfer belt 31 comprises an endless film of about 75 μm to 120 μm thick. Transfer belt 31 is essentially made from polyimide, polycarbonate, thermoplastic elastomer alloy or the like.

Also, transfer belt 31 is tensioned by transfer belt drive roller 32, transfer belt driven roller 33 and intermediate transfer rollers 35 so that its surface comes into contact with the outer peripheral surfaces of photoreceptor drums 21. Transfer belt 31 is adapted to move in the auxiliary scan direction (in the direction of arrow B in the drawing) by the driving force of the transfer belt drive roller 32.

Transfer belt drive roller 32 is disposed at one end side of housing 1*a* and drives the transfer belt 31 by applying a driving force to transfer belt 31 whilst nipping and pressing the transfer belt 31 and a recording sheet together between itself and transfer roller 36 to convey the recording sheet.

Transfer belt driven roller 33 is disposed on the other end side of housing 1*a*, so as to suspend and tension the transfer belt 31 approximately horizontally from the fixing unit 27 side to the other end side of housing 1*a*, in cooperation with transfer belt drive roller 32. However, if the dimension in the width direction of image forming apparatus 1 in FIG. 1 needs to be smaller, that is, if the foot print is made smaller with respect to the width direction in order to achieve space-saving, the position of transfer belt drive roller 32 maybe displaced so that transfer belt 31 is inclined in either way from the fixing unit 27 side to the other of housing 1*a* while the photoreceptors, developing units, laser illuminator, fixing unit and other components may be rearranged and resized as appropriate in association with that change in layout.

Intermediate transfer rollers 35 are arranged in the interior space of transfer belt 31 wound between transfer belt drive roller 32 and transfer belt driven roller 33 and positioned with their axes displaced with respect to axes of photoreceptor drum 21, in the lateral direction in the drawing, to the downstream side with respect to the moving direction of transfer belt 31. Intermediate transfer rollers 35 are arranged so as to press the inner surface of transfer belt 31 and bring its outer peripheral surface into contact with part of the outer peripheral surface of each photoreceptor drum 21, forming a predetermined amount of nip.

Further, intermediate transfer roller 35 comprises a metal (e.g., stainless steel) shaft having a diameter of 8 to 10 mm and a conductive elastic material such as EPDM, foamed urethane etc., coated on the outer peripheral surface of the metal shaft. However, the configuration should not be limited to use of these elastic materials.

The thus formed intermediate transfer roller 35 is applied with a high-voltage transfer bias for transferring the toner image formed on photoreceptor drum 21 to transfer belt 31, i.e., a high voltage of a polarity (+) opposite to the polarity (−) of the electrostatic charge on the toner, so as to apply a uniform high voltage from the elastic material to transfer belt 31.

The visualized toner images (electrostatic images) formed on the photoreceptor drums 21 correspondingly to respective colors are transferred one over another on transfer belt 31, reproducing the image information that has been input to the apparatus. The thus formed laminated image information is transferred to the recording sheet by transfer roller 36 disposed at its contact point with transfer belt 31.

Transfer roller 36 (as a constituent of the transfer means for transferring the developer image transferred to transfer belt 31 to recording paper) is arranged opposing transfer belt drive roller 32 at approximately the same level and in parallel thereto and pressing against the transfer belt 31 wound on the transfer belt driver roller 32. Transfer roller 36 forms a predetermined nip therewith while being applied with a high voltage of a polarity (+) opposite to the polarity (−) of the static charge on the toner, for transferring the multi-color toner image formed on the transfer belt 31 to the recording paper.

In order to produce a constant nip between transfer belt 31 and transfer roller 36, either transfer belt drive roller 32 or transfer roller 36 comprises a hard material such as metal or the like while the other roller is formed of a soft material such as elastic rubber, foamed resin, etc.

A registration roller 26 is provided under transfer belt drive roller 32 and transfer roller 36. This registration roller 26 is configured so as to deliver the sheet toward the transfer roller 36 side by aligning the front end of a recording sheet fed from paper feed portion 109 with the leading end of the toner image on transfer belt 31.

Since the toner adhering to transfer belt 31 as the belt comes in contact with photoreceptor drums 21, or the toner which has not been transferred to the recording sheet by transfer roller 36 and remains on transfer belt 31, would cause contamination of color toners at the next operation, transfer belt cleaning unit 37 is adapted to remove and collect such toner.

Transfer belt cleaning unit 37 includes: a cleaning blade 37*a*, located near transfer belt driven roller 33 and arranged so as to abut (come into sliding contact with) transfer belt 31; and a box-like toner collector 37*b* for temporarily holding the waste toner, left over on and scraped from transfer belt 31 by the cleaning blade 37*a*, to thereby scrape and collect the leftover toner off the transfer belt 31 surface.

Also, transfer belt cleaning unit 37 is arranged near process printing unit 20*a*, on the upstream side of the process printing unit 20*a* with respect to the moving direction of transfer belt 31. Further, transfer belt 31 is supported from its interior side by transfer belt driven roller 33, at the portion where cleaning blade 37*a* comes into contact with the outer surface of transfer belt 31.

Fixing unit 27 includes: as shown in FIG. 2, a pair of fixing rollers 271 consisting of a heat roller 27*a* and pressing roller 27*b*; and a conveying roller 27*c* above the fixing rollers 271. A recording sheet is input from below fixing rollers 271 and output to above conveying roller 27*c*.

Above fixing unit 27, a paper discharge roller 28 is arranged adjacent to conveying roller 27*c*, so that the recording sheet conveyed from conveying roller 27*c* is discharged by the paper discharge roller 28 to paper output tray 43.

Referring to the fixing of a toner image by fixing unit 27, a heating device (not shown) such as a heater lamp or the like, provided inside or close to heat roller 27*a* is controlled based on the detected value from a temperature detector (not shown) so as to keep heat roller 27*a* at a predetermined temperature (fixing temperature) while the recording sheet with a toner image transferred thereon is heated and pressed between heat roller 27*a* and pressing roller 27*b* as it is being conveyed and rolled thereby, so that the toner image is thermally fused onto the recording sheet.

A duplex printing paper path S3 for double-sided printing is constructed adjacent to fixing unit 27, from the rear side of fixing unit 27 downward, with respect to the direction of conveyance, to the vicinity of paper feed portion 109 (FIG. 1). Conveying rollers 29*a* and 29*b* are arranged at the top and bottom and along the duplex printing paper path S3, thereby the recording sheet is inverted and delivered again toward transfer roller 36.

Specifically, conveying roller 29*a* is disposed at the rear of fixing unit 27 and conveying roller 29*b* is located below conveying roller 29*a* with respect to the top and bottom direction and at approximately the same level as registration roller 26.

In the present embodiment, heat roller 27*a* using a heating means made up of a heater lamp etc., is used with pressing roller 27*b*, but an induction heating type heating means may be used alone or in combination. Further, it is not necessary to use a roller as a means for applying pressure. That is, any appropriate method can be used as long as it can uniformly fix the toner image with heat without causing any image disturbance.

Paper feed portion 109 (FIG. 1) includes a manual feed tray 41, a plurality of paper feed cassettes 42 and a large-volume paper feed cassette 81 for holding recording paper to be used for image forming, and is adapted to deliver recording paper, sheet by sheet, from manual feed tray 41, paper feed cassettes 42 or large-volume paper feed cassette 81 to image forming portion 108.

As shown in FIG. 1, manual feed tray 41 is arranged at one side end (on the right side in the drawing) of housing 1*a* of image forming apparatus 1 so that it can be unfolded outside when used and folded up to the one end side when unused. This tray delivers paper, sheet by sheet, into the housing 1*a* of image forming apparatus 1 when the user places a few recording sheets (necessary number of sheets) of a desired type.

Arranged on the downstream side with respect to the paper feed direction (the direction of arrow C in the drawing) of recording paper by manual feed tray 41, inside housing 1*a* of image forming apparatus 1, is a pickup roller 41*a* at the side of exposure unit 10. A conveying roller 41*b* is also disposed at approximately the same level further downstream with respect to the paper feed direction.

Pickup roller 41*a* touches one edge part of the surface of the recording sheet that is fed from manual feed tray 41 and reliably conveys the paper, sheet by sheet, by the function of roller's frictional resistance.

The aforementioned pickup roller 41*a* and conveying roller 41*b* constitute a recording paper conveying path S1.

A multiple number of paper feed cassettes 42 are arranged under the image forming portion 108 and exposure unit 10 in housing 1*a*, so as to accommodate a large amount of recording sheets of sizes specified by the specification of the apparatus or of sizes that are determined beforehand by the user. In this example embodiment, four kinds of recording paper can be accommodated.

Arranged above one end side (the left-hand side in the drawing) of each paper feed cassette 42 is a pickup roller 42*a*. A conveying roller 42*b* is also provided and downstream of the pickup roller 42*a* with respect to the recording paper feed direction.

Pickup roller 42*a* touches one edge part of the surface of the topmost sheet of a stack of recording sheets set on the paper feed cassette 42 corresponding to a printout request and reliably picks up and feeds the paper, sheet by sheet, by the function of roller's frictional resistance.

Conveying roller 42*b* conveys the recording sheet delivered from pickup roller 42*a* upward along a recording sheet feed path S2 formed on one end side inside housing 1*a* to image forming portion 108.

Large-volume paper feed cassette 81 is arranged at the side of the image forming apparatus, detailedly at the side where recording sheet feed path S2 for the paper feed cassette 42 is laid out. Inside this large-volume paper feed cassette 81, a large-volume paper feeder 82 for storing a large amount of recording paper is provided, over which a pickup roller 83 is provided at a position corresponding to one edge part of the surface of the topmost sheet of a stack of the recording sheets set thereon. A conveying roller 84 is arranged on the downstream side of the pickup roller 83 with respect to the recording paper feed direction.

Conveying roller 84 conveys the recording paper delivered from pickup roller 83 toward recording sheet feed path S2 in housing 1*a* from the side of the image forming apparatus.

Next, image output by image forming apparatus 1 of the present embodiment will be described.

Image forming apparatus 1 is constructed so as to transfer the toner images formed on photoreceptor drums 21 to a recording sheet fed from paper feed portion 109 by a so-called intermediate transfer process (offset process) via transfer belt 31.

First, charger 22 uniformly electrifies the outer peripheral surface of photoreceptor drum 21 at a predetermined voltage.

Each electrified photoreceptor drum 21 is irradiated with a laser beam from exposure unit 10, so that an electrostatic latent image for each color is formed on the photoreceptor drum 21 for the color.

Then, toner is supplied from developing units 23*a* to 23*d* to the outer peripheral surfaces of photoreceptor drums 21 so that the static latent images formed on the outer peripheral surfaces of photoreceptor drums 21 are visualized with toner so as to form toner images.

The toner image formed on photoreceptor drum 21 is transferred to transfer belt 31.

Transfer of the toner image from photoreceptor drum 21 to transfer belt 31 is done by application of a high voltage from intermediate transfer roller 35 arranged in contact with the interior side of transfer belt 31.

As intermediate transfer roller 35 is applied with a high voltage of a polarity (+) opposite to that of the polarity (−) of the electrostatic charge on the toner, transfer belt 31 has a high potential uniformly applied by the intermediate transfer roller 35, presenting the opposite polarity (+). Thereby, the toner image bearing negative (−) charge on photoreceptor drum 21 is transferred to transfer belt 31 as the photoreceptor drum 21 turns and comes into contact with transfer belt 31.

The toner images of colors formed on respective photoreceptor drums 21 are transferred to transfer belt 31, laid over, one over another, in the order of yellow (Y), magenta (M), cyan (C) and black (BK) as transfer belt 31 moves to come into contact with each of the rotating photoreceptor drums 21, forming a color toner image on transfer belt 31.

In this way, the toner images developed from static latent images on photoreceptor drums 21 for every color, are laminated on transfer belt 31 so that the image for printing is reproduced as a multi-color toner image on transfer belt 31.

Then, as transfer belt 31 moves and reaches the position where the recording sheet and the transfer belt 31 meet, the multi-color toner image having been transferred on transfer belt 31 is transferred from transfer belt 31 to the recording sheet by the function of transfer roller 36.

Since the toner adhering to transfer belt 31 as the belt comes in contact with photoreceptor drums 21, or the toner which has not been transferred to the recording sheet by the function of transfer roller 36 and remains on transfer belt 31, would cause contamination of color toners at the next operation, it is removed and collected by transfer belt cleaning unit 37.

Next, the operation of feeding recording sheets by paper feed portion 109 (FIG. 1) will be described.

When the recording paper placed on manual feed tray 41 is used, as shown in FIG. 1 the paper is taken in by pickup roller 41*a* from manual feed tray 41, sheet by sheet, at controlled timings in accordance with the instructions from a control panel (not shown), and fed into the machine.

The recording sheet thus taken into the machine is conveyed along recording paper feed path S1 by conveying roller 41*b* to image forming portion 108.

When the recording paper accommodated in paper feed cassettes 42 is used, the paper is separated and fed from paper feed cassette 42, sheet by sheet, by the corresponding pickup roller 42*a* in accordance with a printout request and conveyed by conveying roller 42*b* along recording paper feed path S2 to image forming portion 108.

When the recording paper accommodated in large-volume paper feed cassette 81 is used, recording paper is separated and fed from large-volume paper feeder 82, sheet by sheet, by the pickup roller 83 in accordance with a printout request and conveyed by conveying roller 84 along recording paper feed path S2 to image forming portion 108.

The recording sheet conveyed from manual feed tray 41, paper feed cassette 42 or large-volume paper feed cassette 81 is delivered to the transfer roller 36 side, by registration roller 26, at such a timing as to bring the front end of the recording sheet in register with the leading end of the toner image on transfer belt 31, so that the toner image on transfer belt 31 is transferred to the recording sheet.

The recording sheet with a toner image transferred thereon is conveyed approximately vertically and reaches fixing unit 27, where the toner image is thermally fixed to the recording sheet by heat roller 27*a* and pressing roller 27*b*.

When one-sided printing is selected, the recording sheet having passed through fixing unit 27 is discharged by discharge rollers 28 and placed facedown on paper output tray 43.

In contrast, when double-sided printing is selected, the recording sheet is stopped and nipped at paper discharge roller 28, then the paper discharge roller 28 is rotated in reverse so that the recording sheet is guided to duplex printing paper path S3 and conveyed again to registration roller 26 by conveying rollers 29*a* and 29*b*.

By this movement, the printing face of the recording sheet is inverted and the direction of conveyance is reversed.

Illustratively, the leading edge of the sheet at the first printing is directed to the trailing end when the underside is printed, or the trailing edge of the sheet at the first printing is directed to the leading end when the underside is printed.

After the toner image is transferred and thermally fixed to the underside of the recording sheet, the sheet is discharged to paper output tray 43 by paper discharge rollers 28.

Thus, the transfer operation to recording paper is performed.

Next, the configuration of developing unit 23 and toner supply device 25 according to the present embodiment will be described in detail with reference to FIGS. 3 to 6.

Figure 4:
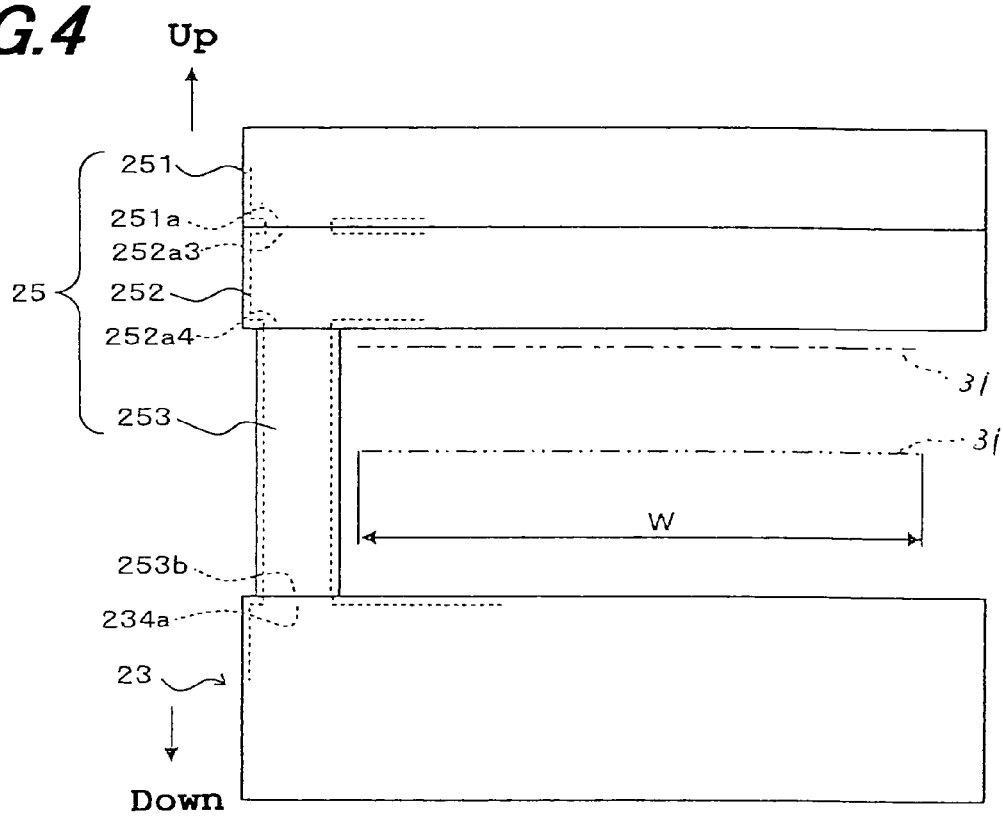
FIG. 4 is an overall front view showing the developing unit and toner supply device.
Figure 5:
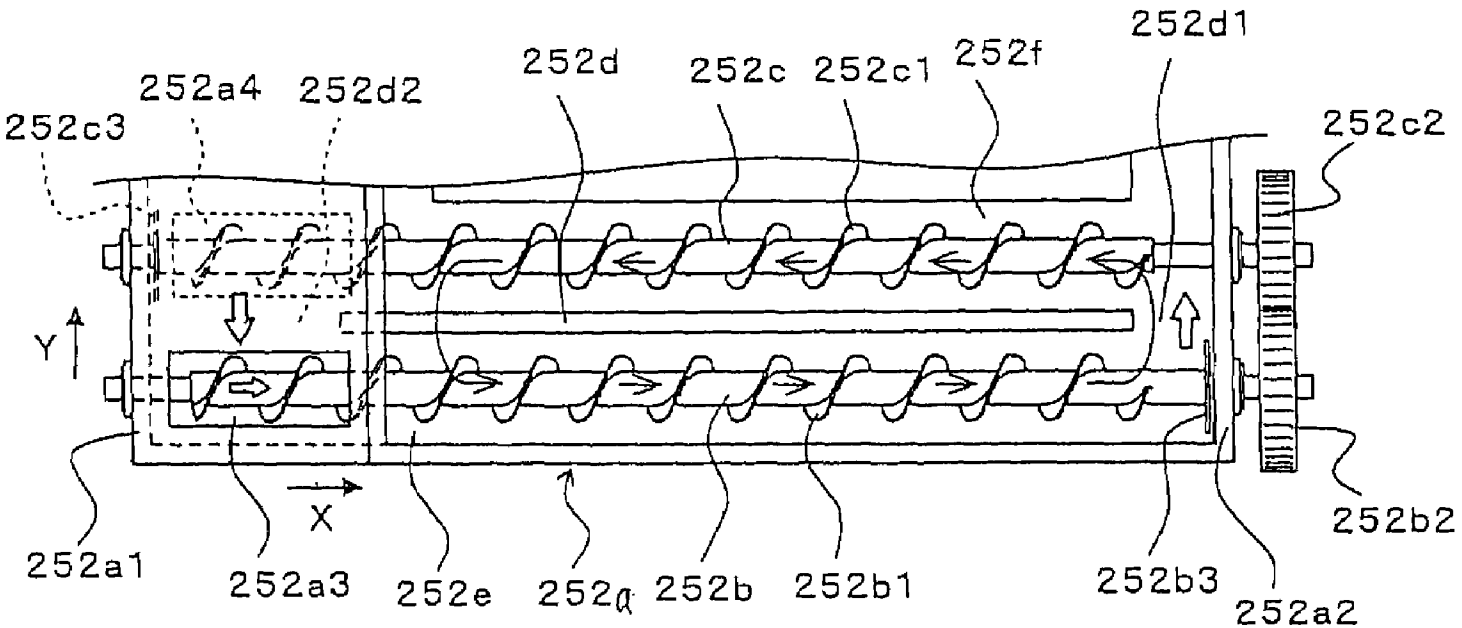
FIG. 5 is a plan view showing a configuration of a toner feed device for constituting the toner supply device.
Figure 6:
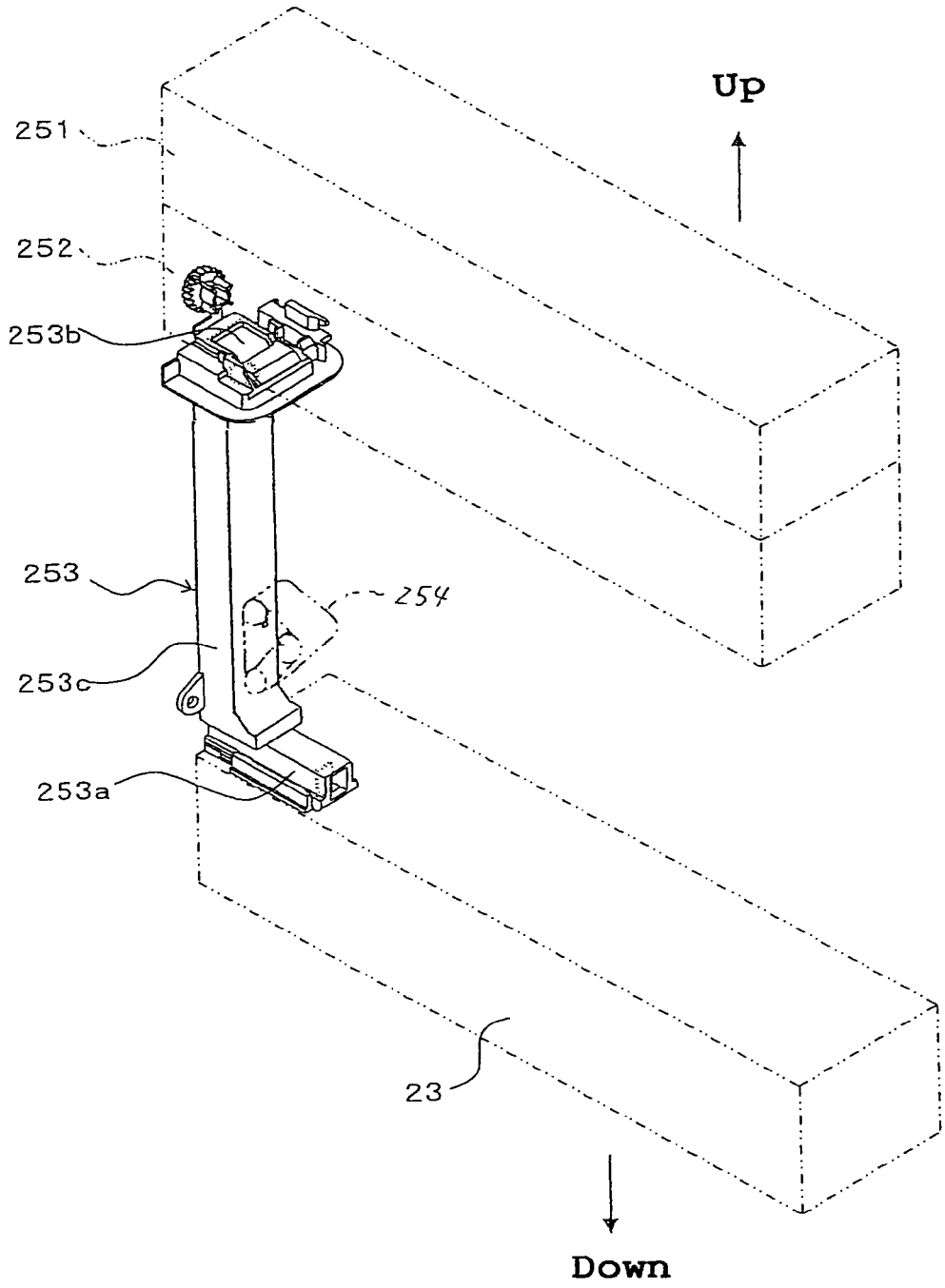
FIG. 6 is an illustrative view showing a configuration of a toner input passage part for coupling the toner feed device and the developing unit.

FIG. 4 is an overall front view showing a configuration of the developing unit and toner supply device, FIG. 5 is a plan view showing a configuration of a toner feed device as a constituent of the toner supply device; and FIG. 6 is an illustrative view showing the configuration of a toner input passage part for coupling the toner feed device and the developing unit.

As shown in FIG. 3, developing unit 23 has a casing 234 that forms its exterior, in which a developing roller 231, a first toner conveying roller 232 and a second toner conveying roller 233 are arranged, and is mounted to the image forming apparatus body with the developing roller 231 opposed in abutment with, or close to, photoreceptor drum 21.

First toner conveying roller 232 and second toner conveying roller 233 are disposed in the bottom of casing 234 in parallel with each other along the direction of axis (axial line) of developing roller 231 (to be referred to merely as the axis direction) so that the toner that is fed into casing 234 is agitated with the developer and conveyed to developing roller 231.

Developing roller 231 is arranged over and above first toner conveying roller 232 so as to be exposed from an after mentioned opening mouth 235.

First toner conveying roller 232 and second toner conveying roller 233 and developing roller 231 are formed with approximately the same length as photoreceptor drum 21.

Casing 234 is a box-shaped configuration elongated in the axis direction of developing roller 231 when it is mounted in the image forming apparatus body, and formed with an opening, i.e., opening mouth 235 so that developing roller 231 therein opposes photoreceptor drum 21 when developing unit 23 is mounted to the image forming apparatus body.

Opening mouth 235 is made open long across the width of casing 234 along the axis direction of developing roller 231 so that at least developing roller 231 will be able to oppose and abut photoreceptor drum 21.

Provided along the bottom edge of opening mount 235 in the drawing is a blade 236 that extends in the axis direction of developing roller 231. Blade 236 is positioned so as to create a predetermined clearance between the blade 236 edge and the developing roller 231 surface, whereby a predetermined amount of toner can be supplied to the developing roller 231 surface through the clearance.

Arranged over the thus constructed developing unit 23 is toner supply device 25.

Toner supply device 25 essentially comprises, as shown in FIGS. 3 and 4, a toner cartridge (toner container) 251, a toner feed device 252, a toner input passage part 253.

As shown in FIG. 4, toner cartridge 251 has a box-shaped configuration elongated in the width direction of transfer belt 31 (the direction perpendicular to the transfer belt's direction of movement) or in the axis direction of photoreceptor drum 21 or developing roller 231, and supplies toner to toner feed device 252 arranged therebeneath.

As shown in FIG. 4, toner supply from toner cartridge 251 to toner feed device 252 is carried out by feeding toner into toner feed device 252 from a toner supply port 251*a* that is formed at a position further outside, or preferably at a position near the outside of, the positions where transfer belt 31, photoreceptor drum 21 and developing roller 231 are mounted, with respect to the direction of width W of transfer belt 31 or the axis direction of photoreceptor drum 21 or developing roller 231.

As shown in FIG. 5, toner feed device 252 has a box-shaped casing 252*a* elongated in the axis direction of developing roller 231 and incorporates therein a first toner agitator shaft (toner conveyor) 252*b* and a second toner agitator shaft (toner conveyor) 252*c*, arranged parallel to each other along the axis direction of developing roller 231.

In the present embodiment, first toner agitator shaft 252*b* and second toner agitator shaft 252*c* are formed longer than width W of transfer belt 31.

The interior of casing 252*a* is divided into a first toner chamber (toner reservoir) 252*e* with first toner agitator shaft 252*b* disposed therein and a second toner chamber (toner reservoir) 252*f* with second toner agitator shaft 252*c* disposed therein, by a partitioning element 252*d*.

First and second toner agitator shafts 252*b* and 252*c* have screws 252*b*1 and 252*c*1 for agitating and conveying toner, respectively, and are driven by an unillustrated drive motor by way of drive gears 252*b*2 and 252*c*2 arranged on the other side 252*a*2 of casing 252*a*.

Toner support plates 252*b*3 and 252*c*3 are provided for first and second toner agitator shafts 252*b* and 252*c*, respectively, at their downstream side ends with respect to the toner conveying direction so as to receive the toner being conveyed.

The toner agitating means should not be limited to screws 252*b*1 and 252*c*1, but it may be a structure in which a multiple number of agitating vanes tilted with the toner conveying direction are formed on the first and second toner agitator shafts 252*b* and 252*c*, for example. Also any other configuration can be used as long as it can achieve the same effect.

Partitioning element 252*d* is formed in casing 252*a* across the casing width along the first and second agitator shafts 252*b* and 252*c*, having toner chamber communication ports 252*d*1 and 252*d*2 formed near both side walls of casing 252*a* to allow for toner passage between first and second toner chambers 252*e* and 252*f*. These toner chamber communication ports 252*d*1 and 252*d*2 permit toner to circulate from first toner chamber 252*e* to second toner chamber 252*f* and from second toner chamber 252*f* to first toner chamber 252*e*.

On the first end side, designated at 252*a*1, of casing 252*a*, a toner input port (toner input portion) 252*a*3 for receiving toner supply from toner cartridge 251 arranged on the top thereof is formed while a toner feed port (toner feed portion) 252*a*4 for delivering the toner from casing 252*a* to toner input passage part 253 that is arranged on the bottom thereof and feeds toner to developing unit 23 is formed.

The opening of toner input port 252*a*3 is formed at a position opposing part of first toner agitator shaft 252*b* for agitating and conveying toner from first end side 252*a*1 to second end side 252*a*2 of casing 252*a*.

On the other hand, the opening of toner feed port 252*a*4 is formed at a position opposing part of second toner agitator shaft 252*c* for agitating and circulatively conveying toner from second end side 252*a*2 to first end side 252*a*1 of casing 252*a*.

Toner input passage part 253 is formed so that its top is integrated with toner feed device 252 and a developing unit attachment portion 253*a* for detachable attachment to developing unit 23 is provided at the bottom thereof, as shown in FIG. 6.

An opening of a toner input port (toner input portion) 253*b* for toner input is formed at the top of toner input passage part 253, and a toner passage 253*c* for toner to pass from this toner input port 253*b* to developing unit attachment portion 253*a* is provided approximately linearly from top to bottom.

Provided for toner passage 253*c* is a toner forwarding device 254 along the toner falling path. Toner forwarding device 254 essentially comprises, as shown in FIGS. 3 and 6, a toner conveyor belt 254*a* for forwarding toner downwards, idle rollers 254*b*1 and 254*b*2 for vertically supporting and tensioning the toner conveyor belt 254*a* and a drive roller 254*c*.

A plurality of ribs, each projectively extended across the belt width, is formed lengthwise on the outer surface of toner conveyor belt 254*a*. These ribs 254*a*1 are provided so as to forward the falling toner without stagnating on the inner wall of toner passage 253*c*.

Drive roller 254*c* applies a drive force to toner conveyor belt 254*a* so that the belt moves downwards in the drawing.

This belt drive may be continuously activated while developing unit 23 is in operation or may be controlled so as to be active as appropriate in accordance with the degree of reduction of the amount of toner in developing unit 23.

An opening of a toner input port 234*a* is formed at a position corresponding to developing unit attachment portion 253*a* on the top of developing unit 23, so that the toner fed through toner passage 253*c* is input into developing unit 23 through developing unit attachment portion 253*a*.

Toner input port 234*a* of developing unit 23 is formed on the same side as that of toner feed device 252 and toner feed port 252*a*4, at a position further outside, or preferably at a position near the outside of, the positions where photoreceptor drum 21 and developing roller 231 are disposed, with respect to the axis direction (longitudinal direction) of photoreceptor drum 21 or developing roller 231.

Next, the operation of toner supply device 25 of the present embodiment will be described.

Toner supply to developing unit 23 by toner supply device 25 is carried out by forwarding toner from toner cartridge 251 to developing unit 23 by way of toner feed device 252 and toner input passage part 253.

To begin with, toner from toner cartridge 251, having passed through toner supply port 251*a* and toner input port 252*a*3 of toner feed device 252, partly moves in the direction of arrow Y in the first toner path that is formed at a position further outside, or preferably at a position near the outside of, the location where developing roller 231 is disposed, with respect to the axis direction (longitudinal direction) thereof, and is forwarded to toner input passage part 253, as shown in FIG. 5. Then the toner is supplied to developing unit 23 by way of the toner input passage part 253. The other toner from toner input port 252*a*3 is fed to first toner chamber 252*e*.

The toner supplied to first toner chamber 252*e* is conveyed from first end side 252*a*1 to second end side 252*a*2 of casing 252*a* as indicated by arrow X as it is agitated by first toner agitator shaft 252*b* in accordance with the predetermined control. The toner having arrived at the end of first toner chamber 252*e* flows into second toner chamber 252*f* through toner chamber communication port 252*d* 1 of partitioning element 252*d*.

The toner having flowed into second toner chamber 252*f* is conveyed from second end side 252*a*2 to first end side 252*a*1 of casing 252*a* as it is agitated by second toner agitator shaft 252*c* in accordance with the predetermined control. The toner having arrived around the first end of second toner chamber 252*f* is forwarded to toner input passage part 253 via toner feed port 252*a*4. Thus, the remaining part of toner by way of the second toner path is fed into developing unit through the toner input passage part 253.

In the present embodiment, the ways from toner input port 252*a*3 to toner feed port 252*a*4 by way of first and second toner chambers 252*e* and 252*f* is assumed to be equal to or longer than twice the width W of transfer belt 31 or the axial (longitudinal) length of developing roller 231, but the distance is not particularly limited, and may be either shorter or longer than that.

Toner fed from toner input passage part 253 to developing unit 23 is fed into developing unit 23 at a position further outside, or preferably at a position near the outside of, the positions where transfer belt 31, photoreceptor drum 21 and developing roller 231 are mounted, with respect to the width W direction of transfer belt 31 or the axis direction of photoreceptor drum 21 or developing roller 231, as shown in FIG. 4.

Thus, the toner conveyor of toner feed device 252 is configured to convey at least a first portion of the toner entering through the toner input portion in a direction which is opposite to the toner input direction (e.g., direction Y) before feeding the first portion of the toner to the developing unit 23, and is further configured to convey and agitate at least a second portion of the toner entering through the toner input portion in a toner circulation path having at least a component parallel to a width direction of the recording paper (e.g., in direction X) before feeding the second portion of the toner to the developing unit 23.

In this way, in developing unit 23, toner can be supplied as appropriate, as required, by toner supply device 25, so that it is possible to stably perform continuous operation without shortage of toner.

When toner in toner cartridge 251 has been consumed and runs short (reduced), developing unit attachment portion 253*a* is dismounted from developing unit 23 with the state that toner cartridge 251, toner feed device 252 and toner input passage part 253 are integrated, so that toner is supplied to toner supply device 25 under the condition that developing unit 23 and toner supply device 25 are separated from each other.

Supplying toner to toner supply device 25 may be performed easily by re-supplying toner into toner cartridge 251 or by replacing the used toner cartridge with a new cartridge full of toner.

According to the present embodiment thus constructed described above, since toner supply device 25 is constructed with toner feed device 252 so that the toner supplied from toner cartridge 251 can be fed to developing unit 23 after its being agitated, it is possible to constantly supply toner that is uniform to the developing unit, hence it is possible to perform stable toner supply based on toner supply control even with the toner having a high enough fluidity.

Since the present embodiment is constructed such that supplying toner from toner input passage part 253 to developing unit 23 is effected using a structure that is located further outside, or preferably near the outside of, developing roller 231 with respect to its axis direction or the width W of transfer belt 31, it is possible to perform toner supply without smudging transfer belt 31.

Further, according to the present embodiment, since toner supply device 25 and developing unit 23 are constructed so that they can be separated from each other by use of developing unit attachment portion 253*a* provided for toner input passage part 253, this configuration facilitates maintenance of toner supply device 25 and toner supply even if toner in toner cartridge 251 is running out.

Though in the present embodiment toner supply device 25 and developing unit 23 are decoupled from each other at toner input passage part 253 as described above, but the coupling mechanism between toner supply device 25 and developing unit 23 is not limited to this. For example, depending on the configuration of image forming apparatus 1, it is possible to provide a configuration in which toner cartridge 251 and toner feed device 252 are separated or in which toner feed device 252 and toner input passage part 253 are separated. That is, the configuration of toner supply device 25 may be developed into any possible form.

In the present embodiment, since toner input passage part 253 is provided as a constituent of toner supply device 25, it is possible to set up the position for supplying toner into developing unit 23 as appropriate. Further, provision of toner forwarding device 254 for toner input passage part 253 makes stable toner supply into developing unit 23 possible without causing any stagnation of toner fed from toner feed device 252 inside toner input passage part 253.

The configuration of toner forwarding device 254 is not limited to that shown in the embodiment, and any configuration may be adopted as long as it can prevent toner from stagnating inside toner input passage part 253.

Though the image forming apparatus 1 of the present embodiment is constructed such that the toner images formed on photoreceptor drums 21 are transferred to transfer belt 31 first and then transferred again to recording paper, it is also possible to apply the present technology to an image forming apparatus of such a type that the toner images formed photoreceptor drums 21 are directly transferred to the recording paper being conveyed by a conveyor belt. Also in this case, needless to say, the same operation and effect can be obtained.

As described heretofore, the configuration of the toner supply device and the developing unit using this in accordance with the present invention is not limited to the above embodiment, and various changes and modifications may be added without departing from the scope of the present invention.

What is claimed is:

1. A toner supply device for supplying toner to a developing unit, the developing unit positioned to have recording paper delivered therealong in a paper feeding direction, the toner supply device comprising:

a toner container configured to store toner; and a toner feed device disposed adjacent to the toner container and comprising:

a toner reservoir configured to hold the toner supplied from the toner container;

a toner input portion configured to allow entrance of toner from the toner container in a toner input direction into the toner reservoir;

a toner conveyor configured to convey at least a first portion of the toner entering through the toner input portion in a direction which is opposite to the toner input direction before feeding the first portion of the toner to the developing unit and configured to convey and agitate at least a second portion of the toner entering through the toiler input portion in a toner circulation path having at least a component parallel to a width direction of the recording paper before feeding the second portion of the toner to the developing unit;

a toner feed portion configured to feed toner from the toner reservoir to the developing unit;

wherein the toner feed device and the toner feed portion are arranged at a location near a side edge portion and on the same side with respect to a direction perpendicular to the paper feeding direction.

2. The toner supply device according to claim 1, wherein the toner feed device comprises a toner input portion configured to allow entrance of toner from the toner container to the toner reservoir, and a toner feed portion configured to feed toner from the toner reservoir to the developing unit;

the developing unit includes a developing roller configured to convey the fed toner to the exterior of the developing unit;

the toner input portion and the toner feed portion are arranged outside the location of the developing roller with respect to a direction along an axis of a developing roller; and wherein the toner conveyor is configured to convey the toner entering from the toner input portion along a direction of the axis of the developing roller first, and then to deliver the toner to the toner feed portion.

3. The toner supply device according to claim 1, wherein the toner conveyor comprises a screw element or a plurality of agitating plates tilted with the toner conveying direction.

4. The toner supply device according to claim 2, wherein the toner conveyor comprises a screw element or a plurality of agitating plates tilted with the toner conveying direction.

5. The toner supply device according to claim 1, wherein the developing unit includes a developing roller configured to feed the fed toner to the exterior of the developing unit;

wherein the toner supply device is configured to supply part of the toner from the toner container to the toner feed portion by way of a first toner path that is created outside a location of the developing roller with respect to a direction of an axis of a developing roller while remaining toner is conveyed to the toner feed portion by way of a second toner path that is extended along the direction of the axis of the developing roller.

6. The toner supply device according to claim 2, wherein part of the toner supplied from the toner container is conveyed to the toner feed portion by way of a first toner path that is created outside a location of the developing roller with respect to the direction of the axis of the developing roller while remaining toner is conveyed to the toner feed portion by way of a second toner path that is extended along the direction of the axis of the developing roller.

7. The toner supply device according to claim 5, wherein the second toner path has a length equal to or longer than a length in the direction along the axis of the developing roller.

8. The toner supply device according to claim 6, wherein the second toner path has a length equal to or longer than a length in the direction along the axis of the developing roller.

9. A developing unit configured for use in combination with the toner supply device of claim 1.

* * * * *